United States Patent [19]

Reyle

[11] 4,143,443

[45] Mar. 13, 1979

[54] PILOT HOLE DOOR MOUNTING APPARATUS

[76] Inventor: John S. Reyle, 343 Van Deunda Ave., Teaneck, N.J. 07666

[21] Appl. No.: 829,776

[22] Filed: Sep. 1, 1977

[51] Int. Cl.[2] ..... E05D 9/00; E05D 11/00; E05B 17/06

[52] U.S. Cl. ..... 16/128 R; 16/137; 33/197

[58] Field of Search ..... 16/137, 128 R; 33/197

[56] References Cited

U.S. PATENT DOCUMENTS

| | | | |
|---|---|---|---|
| 1,050,155 | 1/1913 | Mason | 33/197 |
| 2,790,198 | 4/1957 | Schoen et al. | 16/128 R |

FOREIGN PATENT DOCUMENTS

| | | | |
|---|---|---|---|
| 496940 | 10/1953 | Canada | 16/128 R |
| 28417 | 9/1955 | Fed. Rep. of Germany | 16/128 R |
| 292818 | 3/1964 | Netherlands | 16/128 R |

*Primary Examiner*—James Kee Chi

*Attorney, Agent, or Firm*—Kenyon & Kenyon, Reilly, Carr & Chapin

[57] ABSTRACT

A pilot hole hinge and brad door installing apparatus is disclosed which facilitates door installation by the amateur or unskilled craftperson. Hinge plates used for installing doors in accordance with the invention include pilot holes which receive pilot brads to temporarily install a door in its opening after the companion plates of the hinge are permanently installed on either the door or door jamb. While so temporarily installed, a "trial before error" fitting of the door in its opening and accurate location of the companion plates of the hinge for permanent installation of the door is achieved. The door and hinge plate mortise and screw holes are accurately located and the probability of misalignment or destructive error is reduced.

8 Claims, 14 Drawing Figures

Fig. 5B.
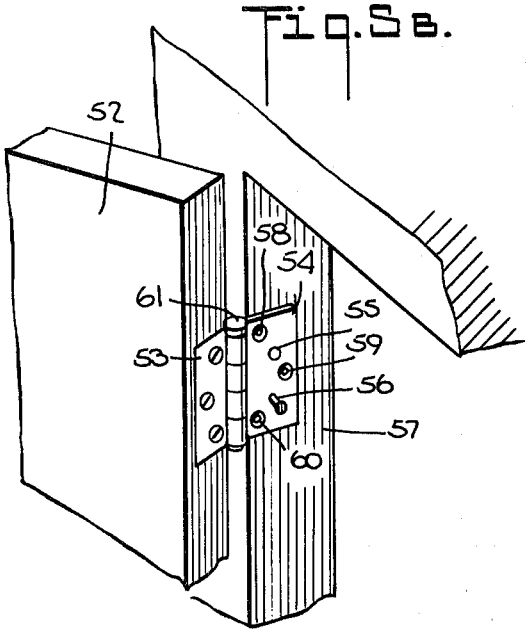
Fig. 6.
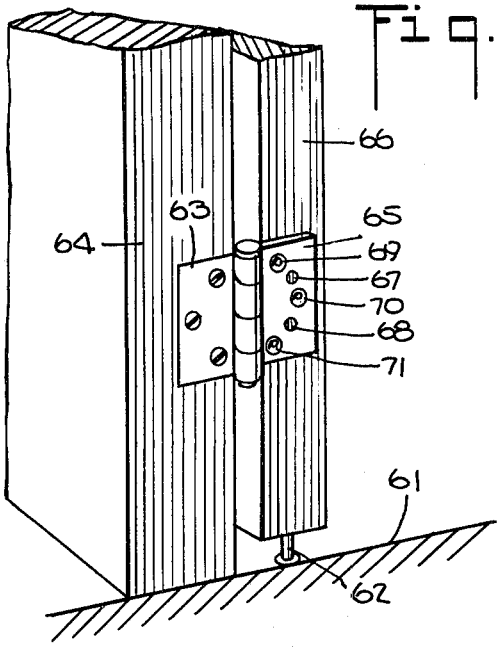
Fig. 8.
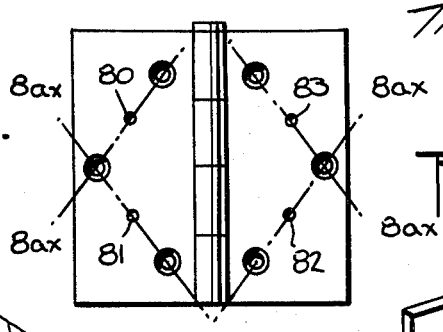
Fig. 9.
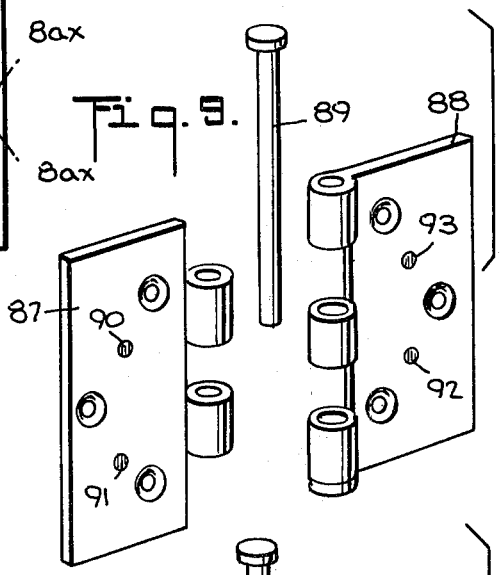
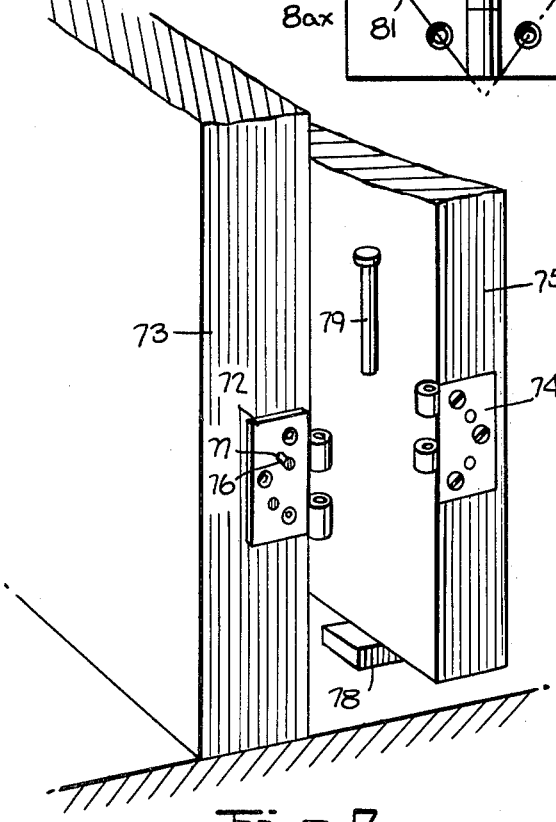
Fig. 7.
Fig. 8A.
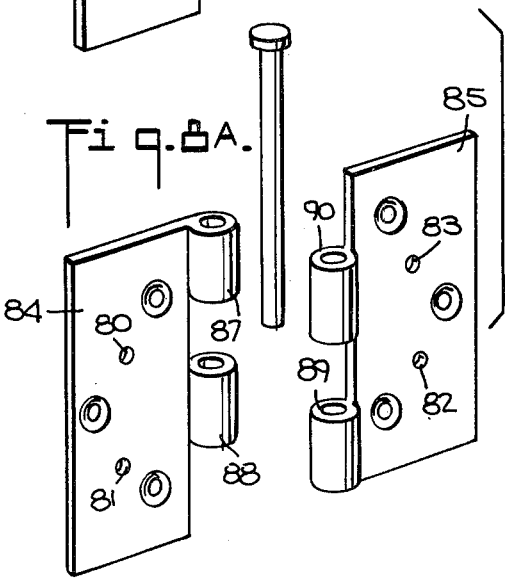

PILOT HOLE DOOR MOUNTING APPARATUS

FIELD OF THE INVENTION

I have invented a novel and useful form of door installing apparatus. More particularly, my invention is useful to the relatively unskilled home craftsperson to allow the home craftsperson easily and without error to hang a wooden door with mortised butt hinges. The pilot hole door mounting apparatus of the invention achieves a high degree of accurcy in door installation and allows improved alignment of the door in its opening, improved trimming of the door, accurate location of hinges on the door jamb, and reduces the probability of mistakes, which in the task of door hanging, usually plague the unskilled or "do-it-yourself" craftsperson. A "trail before error" door installation is allowed. While the invention is particularly aimed to facilitate the work of the at home installer who is usually unskilled, certainly the hinge may also be used incidentally by professionals.

BRIEF DESCRIPTION OF THE PRIOR ART

By prior art apparatus and methods, the task of door hanging by the amateur craftsperson is one of considerable difficulty. For one, a door must fit its opening. Trimming to a proper size is a very difficult task, and improper trimming may destroy a door. Usually, a door is also mortised to receive hinge plates and the door jamb is correspondingly mortised to receive the companion plates of the hinge. It is very often difficult properly to locate the plates on either the door or the jamb once corresponding hinge plates have been located on the other. Screws are used to secure the hinge plates. It is of critical importance, to locate both screw holes and a mortise for receiving a hinge plate accurately if a door is to be properly hung, aligned and balanced. A mislocated screw hole is a common mistake and cannot be easily corrected. The hole must be filled and the presence of the original hole, even though filled, makes difficult the alignment of a proper hole to receive a screw in a proper position. Hence, even relatively minor mistakes easily made by the amateur in locating a mortise or in locating screw holes, may result in an improperly aligned door requiring substantial trimming, damage to woodwork of the door and the door jamb, and an overall unsatisfactory door installation.

Various gauges, templates, and forms of hinges have been suggested by the prior art to facilitate the proper hanging of a door. Several such devices are discribed in U.S. Pat. Nos. 2,516,619; 2,653,388; 2,730,812 and 3,231,929. Such gauges, templates, and hinges all require, however, elements in addition to the hinge for their use, complicating the already difficult task of door hanging and hinge installation. For example, templates and gauges introduce further steps of alignment and locating in the process of door hanging, i.e., alignment of the template, then a second alignment of the hinge to the template location, etc. Others require additional tools which the amateur may not desire to purchase. Further, some templates, gauges, and tools are useful only for one particular hinge, and thus are not reusable for hinges of another size. Also, the cost of a template, tool, or gauge may be substantial in comparison to the cost of a hinge, thus such devices may also be impractical from an economics standpoint.

OBJECTS OF THE INVENTION

It is an object of the pilot hole hinge of this present invention to dispense with such gauges, templates, or special tools designed for use with a particular hinge. The present invention includes a hinge which is intrinsically its own template and gauge for mortising the hinge plates and which allows the opening to be its own template for the purpose of fitting the door into the opening. It requires no specialized tools for its use other than those already available to the home craftsperson and will not add appreciably to the cost of the hinge.

Another aim of this invention is to provide "a trail before error" pilot hole hinge and brad. My invention enables the less experienced relatively unskilled household mechanic to install a door very simply in a highly satisfactory manner without danger of damage to the woodwork or the door, and although making intrinsic use of the hinge, does not mar the esthetics of the installed hinge or door.

In one form, the invention includes pilot holes in hinges to allow a temporary placement of a door so that the mortise may be properly located and subsequently cut to receive the hinge plate. Further, the pilot hole hinge permits the door to be tried for fit and subsequently trimmed so that the door may perfectly be aligned permanently.

BRIEF DESCRIPTION OF THE DRAWINGS

This invention is more particulary described in the following examples taken in conjunction with the accompanying drawings in which:

FIG. 5*b* is a detail view of the installation of one hinge in the course of use of the invention depicted in FIG. 5.

FIG. 6 is a perspective view of an intermediate step in hanging a door using the pilot hole hinge and brad.

FIG. 7 is a perspective exploded view of an alternate form of hinge using the invention in an intermediate step of hanging a door.

FIG. 8 is a front view of an embodiment of the invention.

FIG. 8*a* is an exploded perspective view of one embodiment.

FIG. 9 is an exploded perspective view of another embodiment.

DESCRIPTION OF THE PREFERRED EMBODIMENT

Figures 1, 1A, 2, 3, 3A, 4, 5, 5A:
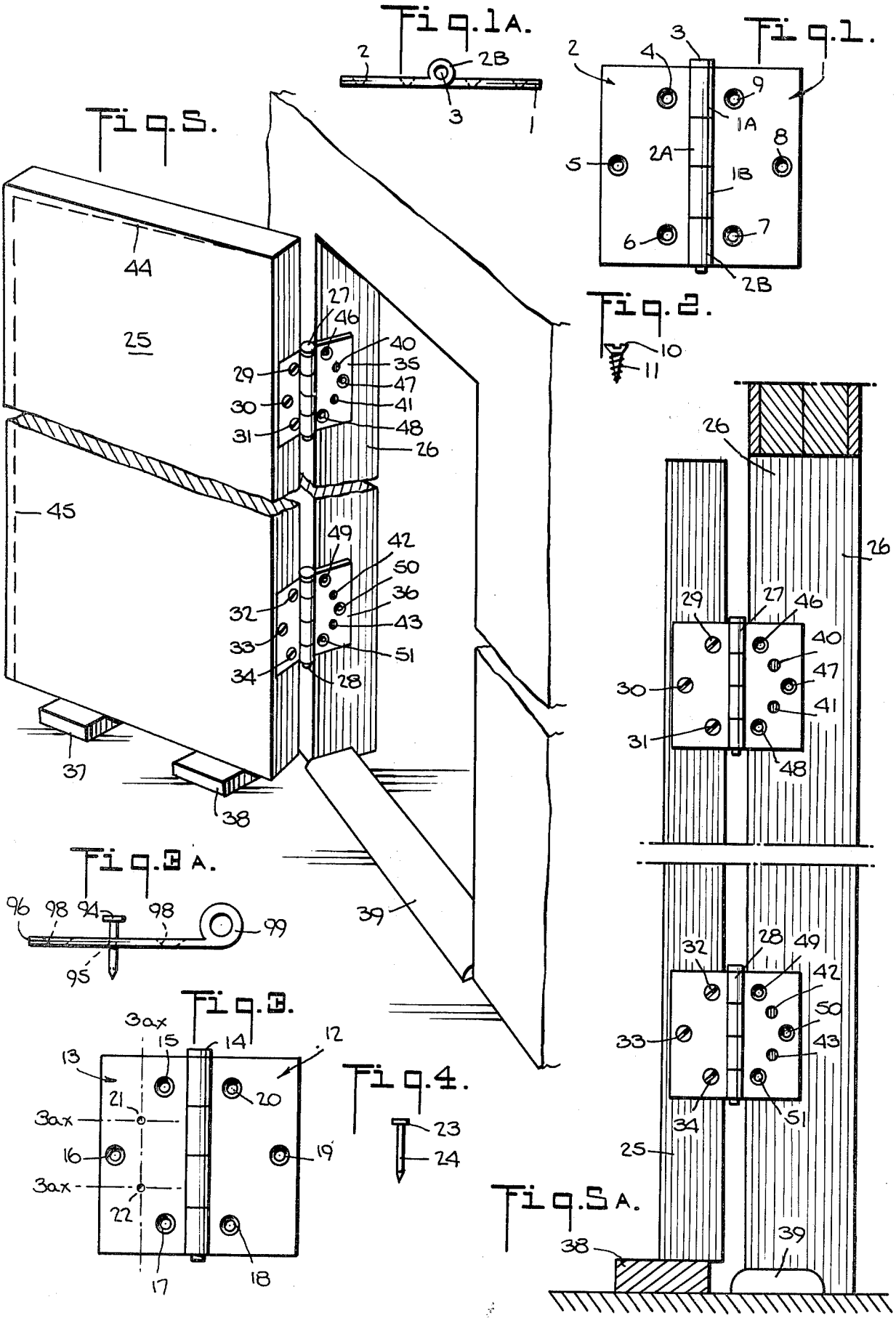
FIG. 1 is a front view of a conventional butt hinge with countersunk holes to receive flat head screws.
FIG. 1*a* is a top view of the hinge of FIG. 1.
FIG. 2 is a flat head wood screw commonly used and provided with the hinges of the type of FIG. 1.
FIG. 3 is a front view of a hinge embodying the invention shown in an open position.
FIG. 3*a* is a top view with a pilot brad inserted.
FIG. 4 depicts the corresponding pilot hole brad used with the hinge of the invention.
FIG. 5 is a perspective view of a door installation at one stage in the process of completion before the door is permanently attached to the jamb in accordance with the invention.
FIG. 5*a* is an end view of the door and jamb installation of FIG. 5.

The pilot hole hinge and brad door mounting apparatus and its method of use are set forth below.

A conventional hinge is depicted in FIG. 1 in which the hinge plates, leaves, or butts are indicated by 1 and 2, a pin connecting the plates by 3, and beveled countersunk screw holes which receive the flat head wood screws depicted in FIG. 2 for permanent mounting of the hinge are indicated at 4,5,6,7,8, and 9. The screw of FIG. 2 includes a flat head, 10, tapering to a threaded shank, 11. The bevel of the countersink of the hinge holes matches the taper of the screw head. Depending on the hinge, the pin, 2, may or may not be removeable to separate the hinge plates.

The plates of the hinge include complimentary extending sleeves at one end, 1*a* and 1*b* for plate 1, and 2*a* and 2*b* for plate 2, which receive the pin, 3, which joins the plates and about which the plates rotate. An end view of the hinge of FIG. 1 is depicted at FIG. 1*a*, showing the sleeve portion, 2*b*, at the end of plate, 2, through which pin, 3, is inserted.

FIG. 3 depicts a hinge utilizing the pilot hole of the present invention, including plates, 12 and 13, pin, 14, and screw holes, 15,16,17,18,19, and 20 as in the hinge of FIG. 1, but also including two relatively smaller, compared to the screw holes, pilot holes, 21 and 22, in at least one plate which during installation receives the temporary pilot hole brad depicted in FIG. 4 in which 23 is the head and 24 the shank.

Preferably, the pilot holes are located between and approximately equidistant the respective screw holes. As depicted in FIG. 3, the pilot holes are along the center line of the plate approximately ⅓ of the way from the upper and lower edge of the plate. Axis lines for locating the pilot holes of the plate are the lines indicated by 3*ax* in FIG. 3.

Alternately, the pilot holes may be located on a three hole hinge approximately centrally along a line joining the frontal and rear screw holes of the plate as depicted by the axis lines 8*ax* in FIG. 8.

The pilot holes preferably should not be in vertical alignment with any screw hole, for the wood of the door and jamb may be weakened when the pilot hole brad and screws are thereafter inserted.

While a hinge with rectangular plates having three screw holes per plate is depicted, the pilot hole and brad trail before error hinge of the present invention may be adapted to any shaped hinge, e.g.; decorative hinges, or a hinge having any number of screw holes. Following the rules of thumb given above, the location of the pilot holes in any particular hinge may readily be determined The pilot hole hinge is also adaptable to be useful with a hinge of any size, thus it may be used to hang relatively small cabinet doors as well as room size doors, except that the hinge of the invention is most ideally suited for use with wooden doors or doors made from some other material capable of receiving a nail brad. The size of the pilot hole and brad in any particular hinge will depend on the size and weight of the door with which a hinge is to be used. As a rule of thumb, the pilot hole brads will be about as long as the screws normally supplied with a hinge by the manufacturer, and of a substantially smaller diameter than the screw body. As a representative example, it has been found that a ¾" brad about 1/16" in diameter is sufficient for use in hanging an ordinary hollow core inside room door. Heavier doors may correspondingly require heavier or larger pilot brads and lighter or smaller doors require correspondingly shorter or lighter pilot brads.

Use of the pilot hole hinge and brad door mounting apparatus in accurately hanging a door is illustrated in the following examples:

EXAMPLE 1

Installation of an inside room door in accordance with the pilot hole hinge is described in this Example with reference to FIG. 5 which is a perspective depiction of a door, 25, mounted to a jamb, 26, in an intermediate step of installation.

Pilot hole hinges such as depicted in FIG. 3, FIGS. 8 or 8*a* or FIG. 9 may be used. for clarity in explaining the invention in this Example, a pilot hole hinge such as depicted in FIG. 3 is used. The leaf of the hinge having the pilot holes is mounted to the door jamb in this Example.

The door, 25, of proper size and thickness related to the opening and use of the door is selected. Usually a door will have approximately ⅛" clearance around all sides to fit into the opening. However, in the initial stage of installation, the door is usually only approximately sized and it may be necessary further to trim the door to fit the opening accurately.

Pilot hole hinges, 27 and 28, of proper size in relation to the size and weight of the door, with a butt plate width usually the same as or less than the thickness or door are used in hanging the door.

The top and lower hinges are located in predetermined positions of the door. Very carefully, the mortise position for the hinge butt plates is scribed on the door edge. As usual, vertical alignment is especially important.

After the door is mortised to a depth not exceeding the thickness of hinge to receive the hinges, the hinges are then secured with screws, 29,30,31,32,33, and 34 at top and bottom of the door.

A temporary shim, 37 and 38, which allows approximately ¼" clearance between the door bottom and the floor or door sill, is tacked to or located at bottom of the door. The door with the hinge leaves permanently affixed is put adjacent the opening at the jamb. If the door opening has a sill, as indicated in FIG. 5 at 39, the shim should allow a conventional clearance between the door and the sill.

The door is then approximately located at the unmortised jamb and the pilot hole leaves of the hinges 35 and 36 are placed approximately against the jamb, 26, as shown in FIG. 5*a*. The pilot hole leaves attached to the leaves on the door are then aligned at the location at the jamb corresponding to the door mounted leaves. The door is then located at the jamb. When so located, the pilot hole brads, 40,41,42, and 43 are nailed through the pilot holes in place in the jamb. Usually the top brad at 40 will be first nailed, then a lower brad at 42, or 43, and then 41, however, the sequence may be at the discretion of the craftsperson. Because the brads and pilot holes are relatively thin, a high degree of accuracy is achieved in mounting and measuring the door and mortises.

After the brads are nailed through the pilot holes, the door is thus temporarily installed and the craftsperson is able to attain a secure "trial before error" allowing him not only properly to locate the jamb, mortise, and screw holes of the hinge plates, but also to inspect, and adjust if necessary the fit of the door in the opening.

The door opening becomes a template for sizing the door. The door is closed with the shim and the fit of the door in the jamb is examined. Around the edges of the jamb a mark may be scribed around the door, such as depicted by the dashed lines at 44 and 45 in FIG. 5.

As examples of the "trial before error" feature of the invention, the door may extend beyond the top of the jamb. In this event, the door will not fully close to allow further measurement. If this occurs, the top of the door is trimmed by filing, or cutting, at the edge of the door at the jamb. This is a tentative slight trimming to allow the door to close for accurately scribing the door for sizing in the jamb. In this trimming, the pilot hole plates and brads are pried from the jamb, the top edge of the door tentatively trimmed, and the door then replaced and held at the jamb by inserting the pilot brads through the pilot holes and redriving them into their original holes in the jamb.

Alternatively, if the top of the door extends beyond the top of the jamb, the shim may be too high. After prying away the plates and pilot brads from the jamb, a lower shim such as cardboard strips can be used to allow the door a lower initial position, thus allowing top clearance. The pilot brads in this instance are driven into the pilot plates and jamb at a new location, usually, below the original holes. To get bottom clearance, the door bottom will be scribed and trimmed.

In either one of these cases, a trial of the door is had and error is corrected relatively easily with minimum effort without making any permanent or final cuts on the door or jamb. Any unevenness, or need for trim, will be readily apparent by the mark, 44, on the top of the door. When trimming the top, the usual approximate ⅛" clearance required mandates that the top be cut ⅛" below the scribed line, 44. On the unhinged edge, the door may not have clearance because of the hinge thickness on the opposite side. Nevertheless, the scribed line, 45, will be exactly parallel with the edge of the door, and whether trimming is required will also be apparent. In trimming the edge, an appropriate allowance in the direction towards the edge trimmed off for the hinge thickness should be made as well as an allowance for the conventional clearance. Thus, only the top and the unhinged edge of the door will require trimming.

The location of the jamb hinge plate is now determined with respect to the door hinge plate.

The hinge plates 35 and 36 also become their own templates for sizing the mortise required and locating the screw holes. A line is scribed about the hinge plates on the jamb. The location of screw holes, 46,47,48,49,50, and 51, for permanent mounting of the hinge is also fixedly determined. These holes are preferably drilled with a conventional drill or screw starter appropriate to the size of the screw used to start the screw hole, before the door is removed and mortises cut in the jamb.

The door is removed and the shim is removed from the door. The pilot hole brads will easily pry out and are discarded. Next the door is trimmed, if necessary. The mortises for the jamb are then cut, preferably to a depth somewhat less than the thickness of the hinge to prevent pinching of the door when closed.

The door is then replaced in the opening and screws appropriate for the hinge permanently driven in the screw holes to affix the pilot hole plates to the jamb. The door should be in perfect fit, balance, and alignment with the jamb. The pilot holes remain in the hinge but do not mar the esthetics of an otherwise perfect installation.

For clarity in the description of Example 1, FIG. 5*a* depicts an edgewise representation of the door at the door jamb during installation while the door is temporarily held to the jamb for fitting measuring and locating the hinge mortises and screw holes. The numbers identifying elements in FIG. 5*a* correspond with those numbers identifying the same elements in FIG. 5.

FIG. 5*b* is a detail view of the upper hinge depicted in FIG. 5. In FIG. 5*b*, a door, 52, is depicted with one hinge plate, 53, permanently affixed to the door. The pilot hole hinge plate, 54, is temporarily attached with the pilot hole brads 55 and 56, to the door jamb, 57. For illustration one pilot hole brad, 56, is depicted as not completely driven into the jamb. The location of the mortise for the pilot hole hinge plate is determined by scribing around the perimeter of the plate extending at the jamb. Screw holes, 58,59, and 60 are appropriately drilled while the pilot hole plate is affixed to the jamb with the pilot hole brads to receive the flathead screws which will be used to secure the plate to the jamb. After the location of the mortise is scribed and the screw holes drilled, the pilot hole plate is pried from the jamb and the pilot hole brads removed and discarded. The mortise is then cut. The hinge pin is depicted at 61.

EXAMPLE 2

The steps of Example 1 are followed, except that instead of using a shim to raise the door bottom above the floor, two short, thin flatheaded nails are driven into each end of the bottom of the door, allowing the heads to protrude allowing approximately ⅛" to ¼" clearance. This will keep the door elevated enough so that when the mortises are marked on the jamb, the floor or sill clearance will have been provided for. The nails must be pulled out or driven home before the door is permanently installed, otherwise the floor or sill may be scratched. The example is shown in FIG. 6 depicting a lower portion of a door installation such as is depicted in FIG. 5, in which 61 indicates the floor and 62 depicts the nails inserted to obtain the proper clearance during measuring and placement of the door.

EXAMPLE 3

Referring to FIG. 6, one hinge plate, 63, is first permanently affixed to the jamb, 64. The pilot hole plate, 65, is temporarily attached to the door, 66, with pilot hole brads 67 and 68. The door is closed and sized, the location of the mortise in the door to receive the pilot hole plate is marked about the perimeter of the plate, 65, and the screw holes drilled at 69, 70, and 71. The pilot hole plate is then removed from the door, the mortises for the plate cut and the door trimmed if needed. The door is returned, the plate, 65, inserted into the mortise cut into the door and screwed in permanently.

EXAMPLE 4

In this Example, a pilot hole hinge having a removeable pin is used. Such an installation is depicted in FIG. 7 in which a pilot hole leaf, 72, of the hinge is affixed to the jamb, 73. The other leaf of the hinge, 74, is affixed to the door, 75. The removeable pin is at 79. In FIG. 7, the hinge leaf, 74, is shown fully mortised into the edge of the door and permanently screwed in. The pilot hole leaf at the jamb, 72, is not yet mortised and is depicted, for illustration only, with a pilot brad, 76, extending from a pilot hole, 77. The steps of Example 1 are followed and a shim or nail is used to provide bottom clearance. In FIG. 7, a shim, 78, is used. After scribing the door, instead of removing the door and hinges, however, as in Example 1, in this Example the pins, 79, are removed from the hinge, leaving the pilot hole leaf affixed to the jamb. A scribe is made around the hinge, and the screw holes started. The leaf is removed and the mortise cut. The hinge leaf is thereafter screwed into the mortise. The door is trimmed, if needed, and returned. The hinge leaves are joined by inserting the pins, 79, to join the complimentary leaves, 74 and 72, of the hinge. Again the door will fit perfectly.

EXAMPLE 5

In the manufacture of the pilot hole hinge, it is not necessary that only one leaf of the hinge be equipped with pilot holes. Identically symmetrical leaves may be manufactured, each with pilot holes and assembled, resulting in a hinge with pilot holes on either side such as the hinge depicted in FIG. 8 in which pilot holes are indicatated at 80,81,82, and 83. This would be a preferable way to manufacture pilot hole hinges with removeable pins for inclusion of pilot holes on either leaf would allow the craftsperson the greatest number of options, e.g., door first or jamb first mounting of the hinge plate whether the door were to be hung from the left or right hand side of the jamb.

If pilot holes were in one leaf of the hinge only, a hinge with a removeable pin would be useful only for left or right hanging of a door. This Example allows the hinge to be useful for either side. FIG. 8*a* depicts an exploded perspective view of a hinge with identical pilot hole leaves, 84 and 85 with a pin, 86, adapted to be inserted into the hinge sleeves, 87,88,89, and 90 to join the hinge in accordance with this Example. While the pilot hole hinges of this Example include four pilot holes, pilot brads are required only for one leaf of each hinge to be useful in door installation, hence, only two pilot brads are necessary per hinge in this Example.

EXAMPLE 6

In this Example depicted in FIG. 9, the pilot hole invention is shown to be useful in a hinge with non-symmetrical sleeves joining the hinge plates 87 and 88 with pin, 89. Here the pilot holes are indicated at 90,91,92, and 93.

Of course, in the foregoing examples where only one hinge is depicted, it will be understood that the one hinge example is for clarity and that the invention is applicable as well to installation where a plurality of hinges are employed.

In summary, my pilot hole hinge and brad and the methods of its use described above greatly facilitates the task of the amateur, do-it-yourselfer, or unskilled home craftsperson in the usually burdensome task of door hanging.

It should be noted that the pilot holes are preferably not tapered, as are the screw holes. Rather the pilot holes are of uniform diameter extending through the thickness of the hinge plate. The diameter of the pilot hole is correspondingly adapted to receive the pilot brad. The relationship of pilot hole and brad is depicted in FIG. 3*a*, a cross section of a hinge plate with pilot brad inserted, in which 94 depicts the brad, or shown in FIG. 4, partially inserted into the pilot hole in a hinge plate, 96, in which screw hole cross sections are indicated at 97 and 98 and the sleeve at 99.

It is anticipated that pilot hole hinges with appropriately sized pilot brads (two per hinge) will be packaged as a unit including screws and sold with accompanying instructions detailing the procedure described herein for proper use of the pilot hole hinge.

While certain specific embodiments are described herein, they are illustrative. Other variations of the pilot hole hinge described may be apparent from the foregoing description.

With reference to the foregoing specification, I claim as my invention, the following:

1. In apparatus for the installation of a door at an opening, said apparatus being for accurately sizing and hanging the door, the door being hinged to a jamb at an opening by at least one double mortised butt hinge having a pair of hinge plates joined by a pin, one plate being attached to the door and the other being attached to the jamb, in which installation, a first plate of the pair of hinge plates is permanently secured at a predetermined location in a mortise at the edge of one of the door and jamb, and the other of the one of the door and jamb is mortised to receive the second hinge plate in the mortise formed, the second hinge plate to be held securely to the other of the one of the door and jamb by at least one screw, the location of the second hinge plate in the other of the one of the door and jamb corresponding to the predetermined location at which the first hinge plate is permanently secured to the one of the door and jamb, and during which installation the door is sized, the mortise for the second hinge plate is located and cut, and the location of the hole to receive the at least one screw which secures the second hinge plate is identified, the improvement consisting of the pilot hole hinge and brad which includes:

a pair of joinable substantially solid, flat, rectangular, butt hinge plates, each having at least one extending sleeve complimentary with the other, said sleeve being adapted to receive a pin which joins the plates and about which the plates rotate, a pin adapted to join the hinge plates through the extending complimentary sleeves, the first hinge plate adapted to be permanently secured at a predetermined location in a mortise to one of the door and jamb, the second plate of the pair having at least one screw hole adapted to receive a screw to affix said plate permanently to the other of the one of the door and jamb in the mortise which is to be cut to the size of the second plate to receive the plate therein, the second plate also including a pair of small pilot holes, the pilot holes being of relatively smaller diameter than the screw hole and being further adapted to accommodate a pilot brad, the pilot holes being further located at points along a linear axis in the hinge plate which linear pilot hole axis is separate from any other axis line parallel to the edges of the rectangular hinge plate on which other axis line any of the at least one screw hole is located, a pair of pilot brads, each pilot brad having a head of a diameter greater than the diameter of the pilot hole and a shaft adapted to be driven through the pilot hole of the second hinge plate into the other of the one of the door and jamb, the pilot brads being further adapted, when driven through the pilot holes into the other of the one of the door and jamb, temporarily to affix the second hinge plate to the other one of the door and jamb at a location thereon corresponding to the location of the hinge plate permanently affixed to the one of the door and jamb, at the opening where the door is to be installed, the second hinge plate so temporarily affixed being adapted to allow the opening to be a template for itself for accurately sizing the door and the second hinge plate to be a template for itself both for accurately locating the mortise for the second plate and for accurately locating the at least one screw hole which receives the at least one screw which permanently secures the second plate to the other of the one of the door and jamb in the mortise to be cut which is to receive the second plate, the pilot brads being further adapted to be easily removed from the other of the one of the door and jamb, after the door is sized with respect to the opening and the mortise and screw holes for the second hinge plate are accurately sized and located.

2. The pilot hole hinge and brad of claim 1 in which the pin permanently joins the pair of hinge plates.

3. The pilot hole hinge and brad of claim 1 including a removable pin.

4. The pilot hole hinge and brad of claim 1 in which the first and second hinge plates both include a plurality of screw holes and the first hinge plate is permanently secured with screws in a mortise at the edge of the one of the door and jamb.

5. The pilot hole hinge and brad of claim 4 in which the first hinge plate also includes a pair of pilot holes.

6. The pilot hole hinge and brad of claim 5 in which the first and second hinge plates are identical and have corresponding complimentary sleeves.

7. The pilot hole hinge and brad of claim 6 in which the identical hinge plates include:

three screw holes in each hinge plate, the screw holes being located at the points of an arbitrary isosceles triangle within the rectangle of the hinge plate, the base of the isosceles triangle being parallel to and located proximate to the edge of the hinge plate adjacent the sleeve, and in which the pair of pilot holes in each hinge plate are located at approximately the mid-point of each equal side of the triangle.

8. The pilot hole hinge and brad of claim 1 in which each pilot hole in located along a central line in the hinge plate, which line is parallel to the edge of the rectangular plate from which the sleeve extends and in which each pilot hole is located at a point approximately one-third the length of the line extending along the plate from each of the two outer edges of the plate which the line intersects.

* * * * *